US006364442B1

(12) United States Patent
Kawase et al.

(10) Patent No.: US 6,364,442 B1
(45) Date of Patent: Apr. 2, 2002

(54) PRINTING APPARATUS, AND A CONTROL METHOD FOR RESETTING THE PRINTING APPARATUS

(75) Inventors: Yuji Kawase, Matsumoto; Hidetake Mochizuki, Azusagawa-mura; Mitsuaki Teradaira, Shiojiri, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/173,704

(22) Filed: Oct. 15, 1998

(30) Foreign Application Priority Data

Oct. 16, 1997 (JP) ..... 9-284125

(51) Int. Cl.[7] ..... B41J 2/165; B41J 29/38
(52) U.S. Cl. ..... 347/5; 347/23
(58) Field of Search ..... 347/23, 5, 19; 358/1.16

(56) References Cited

U.S. PATENT DOCUMENTS 5,572,242 A * 11/1996 Fujii et al. ..... 347/23
5,576,746 A 11/1996 Suzuki et al. ..... 347/14
5,784,080 A 7/1998 Nitta et al. ..... 347/23
5,793,388 A * 8/1998 Martinson et al. ..... 347/23
5,970,225 A * 10/1999 Jackson et al. ..... 395/117
6,070,960 A * 6/2000 Nakajima ..... 347/23
6,109,724 A * 8/2000 Takahashi et al. ..... 347/23
6,138,181 A * 10/2000 Aida et al. ..... 710/11

FOREIGN PATENT DOCUMENTS

EP 0 559 122 9/1993 ..... B41J/2/165
EP 0 647 056 4/1995 ..... H04N/1/00
JP 57-111751 7/1982 ..... G06F/11/14
JP 8-142450 6/1996

* cited by examiner

*Primary Examiner*—John Barlow
*Assistant Examiner*—Julian D. Huffman
(74) *Attorney, Agent, or Firm*—Michael T. Gabrik

(57) ABSTRACT

An apparatus and method for cleaning a printing apparatus based on printing apparatus status information that is stored to memory in response to an externally generated reset signal. Based on the stored information, a cleaning process appropriate to the printer status is selected and performed, thereby minimizing ink consumption. In particular, when a CPU of the printing apparatus detects an external reset signal, which is based on the reset signal received from a host computer 65, the CPU writes the cleaning time, reset time, and other printing apparatus status information to a non-volatile RAM. The CPU is then forcibly reset by an internal reset signal. After being reset, the CPU reads the status information from the non-volatile RAM, and selects and implements a cleaning process appropriate to the stored status information. Ink consumption by the printing apparatus can thus be minimized, and reliable cleaning and printing can be maintained.

56 Claims, 11 Drawing Sheets

PRINTING APPARATUS, AND A CONTROL METHOD FOR RESETTING THE PRINTING APPARATUS

BACKGROUND OF THE INVENTION

1. Field of the Invention

The present invention relates to a printing apparatus, and more particularly relates to a process for resetting the printing apparatus, and to a method for cleaning the print head of an ink jet type printing apparatus.

2. Description of the Related Art

Printers and other types of information processing devices typically implement a specific initialization process when a reset signal is asserted. The reset signal can be a power-on reset signal, which is asserted when the power is turned on, or a reset signal sent through an interface to the printing apparatus by a host computer, for example.

With a power-on reset, the power switch has typically been turned off at some point prior to being turned on. In many newer model printers, the power supply is not interrupted immediately when the power switch is turned off, but instead is interrupted after waiting a predetermined delay period. The printing apparatus also typically performs a particular process during this delay period (simply called a "shutdown process" below). This shutdown process can include, for example, initializing certain mechanical parts, such as the moving of the print head to a retracted position, and the backing up of processed data or maintenance data such as certain counter and time values. See, for example, JP-A-56-124977, JP-A-61-233819, JP-A-2-93811, JP-A-4-288274, and JP-A-7-261888. Such shutdown processes enable processed information or states stored when the power switch was turned off to be reflected in printer operation when the power switch is turned on again.

When a reset signal is issued from a host computer or other connected device, however, the reset operation is executed immediately to reinitialize the printing apparatus. As a result, the shutdown process implemented when the power switch is turned off cannot be executed. Some of the problems associated with this reset method when applied in an ink jet printer are described further below.

Ink jet printers, which print by ejecting ink from an ink jet head onto a print medium, require regular maintenance; that is, they require the cleaning of the ink jet head nozzles in order to sustain reliable ink jet head operation. Such regular cleaning is needed to prevent such problems as clogged nozzles which results from the ink drying and becoming viscous inside the nozzles.

This cleaning process is generally managed based on a timer, and is implemented with different levels depending on how much time has passed since the last cleaning operation, and ink jet head capping. This means that storing this timer value when the power is turned off enables the next cleaning operation to be more appropriately performed. It is also possible to record such counter values as an ink end counter, which is indicative of how much ink remains, and a print pass counter, which is indicative of the print volume and can be used as a guide to mechanical parts wear. These counters are used as a guide to maintenance requirements, including parts replacement.

When POS printers, networked printers, and other printing apparatuses that are controlled by a host computer are remotely located, full remote control of printing apparatus operation must be possible. This includes the ability to control, by means of a reset signal asserted from the host computer, execution of an initialization process that is essentially the same as the initialization process performed in response to a reset signal as is generated when the power switch is turned on.

A reset signal can, however, be asserted at various times, including when the host computer is turned on, when the operating system boots up, when an application boots up, and when an application starts printing. As a result, multiple reset signals can be sent to the printer at relatively short intervals depending upon the computer type, application, and printer driver.

In such cases as mentioned above, conventional printers do not have the opportunity to store the counter values, time information, and other maintenance information, and this information is therefore lost. Cleaning and parts replacement may therefore not occur as needed, and problems with print quality and printer breakdown may result.

Loss of print quality has therefore been prevented by performing the head cleaning process at the initialization level every time a reset signal is received. This, however, consumes more ink than is really necessary, and thus increases the operating cost of the printer. The number of expended ink cartridges also increases, which is obviously not desirable in terms of resource conservation and environmental protection.

There is therefore a need for a printing apparatus capable of performing a process equivalent to the power-on reset operation when a reset signal is received from a host computer. There is a further need for a printing apparatus cleaning method whereby a process equivalent to the power-on reset operation can be performed when a reset signal is received from a host computer.

OBJECTS OF THE INVENTION

It is therefore an object of the present invention to overcome the aforementioned problems.

It is a further object of this invention to provide a printing apparatus and reset and cleaning control method therefor, wherein, when the printing apparatus receives a reset signal, it stores specific printing apparatus status information, performs a reset operation which is the same or similar to that performed in response to a power-on reset signal, reads the stored status information to select the most appropriate cleaning process level based on the stored information, and performs the selected cleaning process.

SUMMARY OF THE INVENTION

To accomplish this, a printing apparatus connected to a host computer for printing to a printing medium based on data received from the host computer comprises, according to the present invention, non-volatile memory, a control means, an initialization means, and a reset signal processing means. The nonvolatile memory stores printing apparatus status information. The control means controls printing apparatus operation, including writing and reading information to said non-volatile memory. The initialization means reads specific status information written to the non-volatile memory and effects an initialization process according to a reset signal from the host computer or printing apparatus power on operation. The reset signal processing means receives a reset signal from the host computer, applies an external reset signal to the control means to inform the control means that a reset signal was received, and then applies an internal reset signal to the control means after a specific delay from applying the external reset signal. Thus informed that a reset signal was received, the control means writes at least the printing apparatus status information required for the initialization process to non-volatile memory during the period between when the external reset signal and internal reset signal are applied.

A printing apparatus according to an alternative version of the present invention comprises an ink jet head cleaning mechanism, non-volatile memory, a control means, and a reset signal processing means. The non-volatile memory stores printing apparatus status information. The control means controls printing apparatus operation, including writing and reading information to said non-volatile memory, and controls the cleaning mechanism using one of a plurality of process levels each consuming a different amount of ink. The reset signal processing means receives a reset signal from an external source, applies an external reset signal to the control means to inform the control means that an external reset signal was received, and then applies an internal reset signal to the control means after a specific delay from applying the external reset signal. The internal reset signal used here is the same as the reset signal applied when printing apparatus power is turned on. Thus informed that a reset signal was received, the control means writes the printing apparatus status information to non-volatile memory during the period between when the external reset signal and the internal reset signal are applied. After the internal reset signal is applied, the control means reads the printing apparatus status information stored to non-volatile memory, selects a specific process level based on the read information, and controls the cleaning mechanism according to the selected process level.

The present invention further addresses the above-stated needs by providing a control method for resetting a printing apparatus. This control method comprises an initialization step, a read initialization step, a notification step, a status information storage step, and an internal reset signal step. The initialization step initializes a non-volatile memory for storing printing apparatus status information, and a control means for controlling printing apparatus operation, including writing and reading information to said non-volatile memory. The read initialization step reads specific status information written to memory according to a reset signal from a host computer or printing apparatus power on operation. The notification step receives said reset signal, and applies an external reset signal to the control means to inform the control means that a reset signal was received. The status information storage step stores at least printing apparatus status information required for the initialization process to memory. The internal reset signal step applies an internal reset signal to the control means after a specific delay from applying the external reset signal.

A control method according to a further version of the invention comprises an initialization step, a notification step, a status information storage step, an internal reset signal step, a process level selection step, and a control step. The initialization step initializes an ink jet head cleaning mechanism, memory for storing printing apparatus status information, and a control means for controlling printing apparatus operation, including writing and reading information to said memory, and controlling the cleaning mechanism using one of a plurality of process levels each consuming a different amount of ink. The notification step receives said reset signal, and applies an external reset signal to the control means to inform the control means that a reset signal was received. The status information storage step stores printing apparatus status information to memory. The internal reset signal step applies an internal reset signal to the control means after a specific delay from applying the external reset signal. This internal reset signal is the same as the reset signal applied when printing apparatus power is turned on. The process level selection step reads printing apparatus status information stored to memory, and selects a specific process level based on the read information. The control step controls the cleaning mechanism according to the selected specific process level.

These and other objects and features of the present invention will be readily understood from the following detailed description taken in conjunction with preferred embodiments thereof with reference to the accompanying drawings, in which like parts are designated by like reference numerals and in which:

BRIEF DESCRIPTION OF THE DRAWINGS

In the drawings, wherein like reference symbols refer to like parts.

Figure 1:
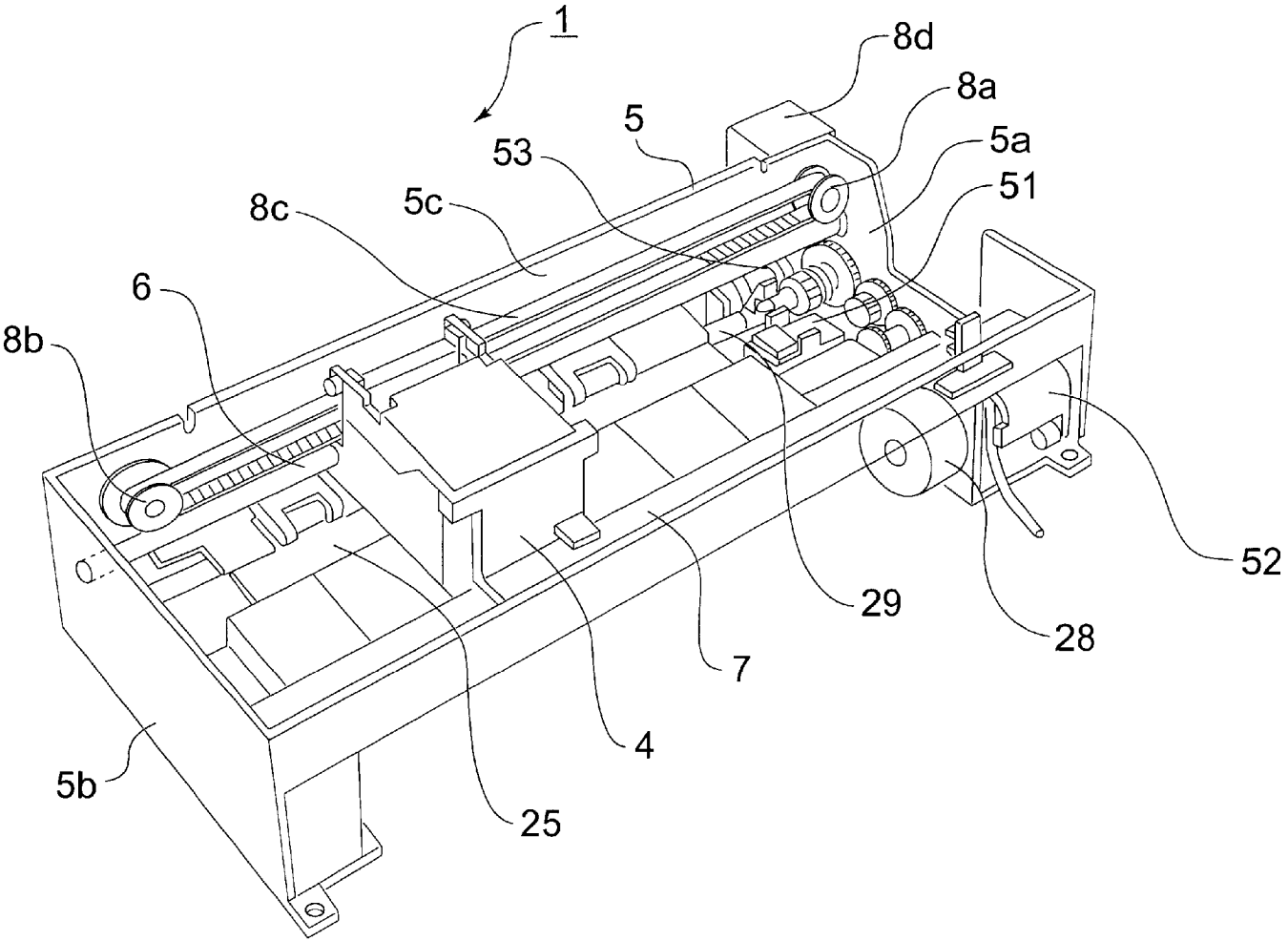
FIG. 1 is a typical overview of the major components of a printer according to a preferred embodiment of the present invention.

KEY TO THE FIGURES.

1 printer
2 ink jet head
4 carriage
61 CPU
62 non-volatile RAM
63 real-time clock (RTC)
65 host computer
66 working RAM
67 ROM
70 reset signal processing unit
71 reset detector
72 reset delay timer
73 reset signal generator
80 ink system
90 printing mechanism
91 DIP switch

DESCRIPTION OF THE PREFERRED EMBODIMENTS

Figure 2:
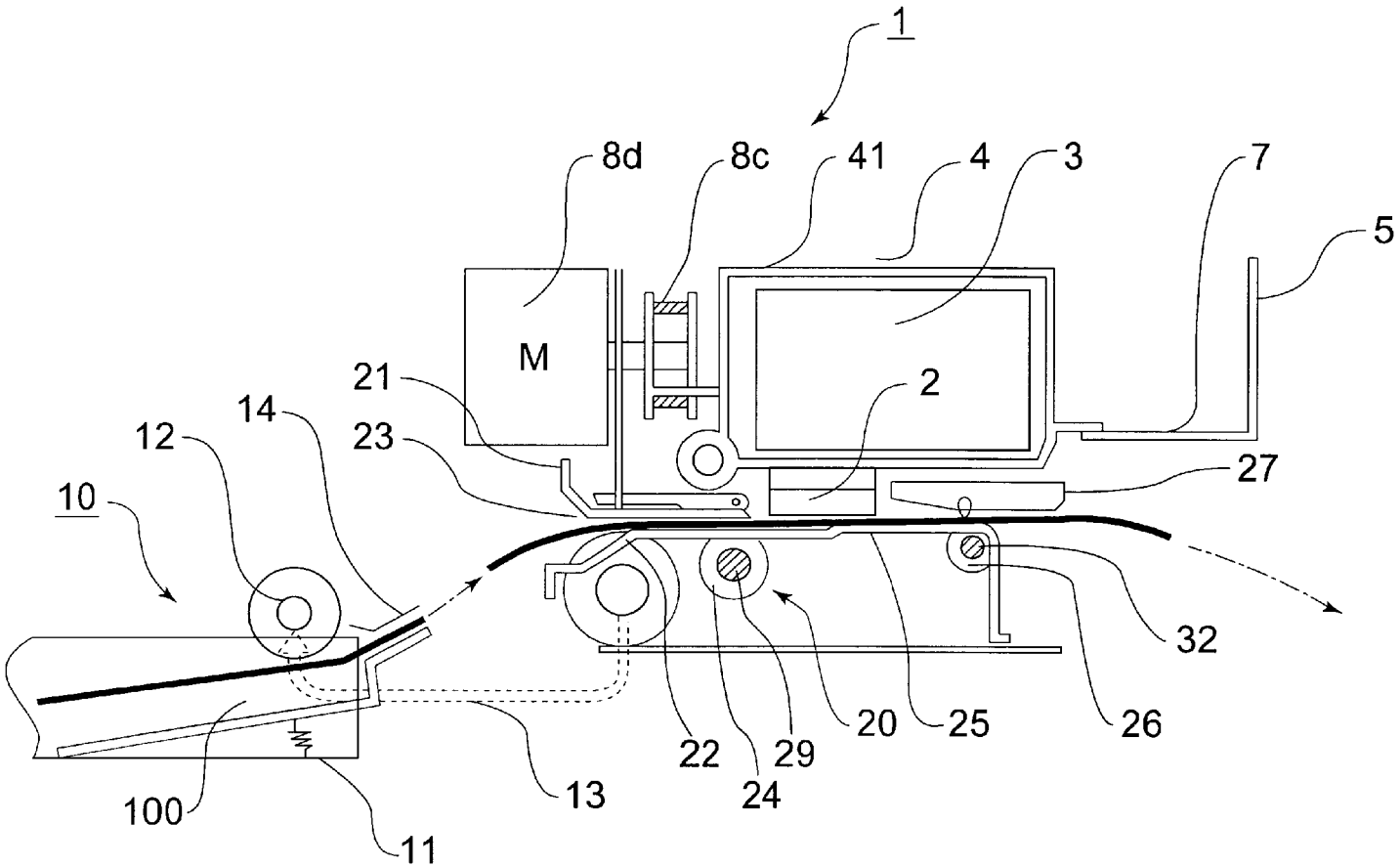
FIG. 2 is a typical section view through the printing position in a printer shown in FIG. 1.

A preferred embodiment of an ink jet printer according to the present invention is described below with reference to the accompanying figures. FIG. 1 and FIG. 2 show the major parts of an ink jet printer according to the present invention. The printer shown may be used as a stand-alone printer or as the printing unit of any type of printing apparatus including the printing unit in combination with other components. In both cases the printer shown will be mounted in some housing. Because the present invention does not impose any particular restrictions on such housing, a housing is neither shown nor further explained.

As will be understood from FIGS. 1 and 2, a printer 1 according to the present embodiment is a serial printer which prints by means of an ink jet head 2 and ink tank 3 mounted on a box-like carriage 4, which travels bidirectionally in a linear path in the scanning direction for printing. The ink jet head 2 and ink tank 3 are typically a cartridge which can be loaded into and removed from the carriage 4 by opening a top cover 41 of carriage 4.

So that it can move bidirectionally on a linear path lengthwise to a frame 5, the carriage 4 is supported such that one side thereof can slide freely on a guide shaft 6 and the opposite side can slide freely on the top of a guide plate 7. Both the guide shaft 6 and guide plate 7 are disposed between right and left side walls 5*a* and 5*b* of the frame 5.

A drive pulley 8*a* is mounted at one end of the front wall 5*c* of the frame 5, and a driven pulley 8*b* is mounted at the other end. A carriage motor 8*d* is mounted at the front wall 5*c* of the frame 5 and connected to the drive pulley 8*a*. A timing belt 8*c* connects the two pulleys 8*a* and 8*b*, and is also connected to the front of the carriage 4. As a result, when the drive pulley 8*a* is turned by the carriage motor 8*d*, the drive pulley 8*a* drives the timing belt 8*c*, and the carriage 4 is moved by the timing belt 8*c* along the guide shaft 6.

An automatic paper feeding mechanism 10 for supplying a cut sheet form 100 is provided in front of the frame 5. The automatic paper feeding mechanism 10 comprises a cassette 11, a feed roller 12, a power transfer mechanism 13, and a paper path 14. The cassette 11 holds a plurality of cut sheet forms 100. The feed roller 12 feeds the cut sheet forms 100, one sheet at a time, from the cassette 11 into the paper path 14. The power transfer mechanism 13 (indicated by double dotted lines in the figure) transfers drive power to the feed roller 12. The paper path 14 guides the cut sheet form 100 from the cassette 11 to a position from which a cut sheet transport mechanism 20 inside the frame 5 can further transport the form to a printing position. The power transfer mechanism 13 therefore comprises a clutch mechanism whereby the power transfer mechanism 13 is held in an off (disconnected) state during normal printing operations, and is switched to an on (connected) state only when necessary, thereby transferring drive power to the feed roller 12 as needed.

The cut sheet transport mechanism 20 in the frame 5 comprises a cut sheet insertion opening 23, which is defined by a pair of upper and lower guide plates 21 and 22. When a cut sheet form 100 is fed by the automatic paper feeding mechanism 10 to the cut sheet insertion opening 23, it is then grasped by a transport roller 24. The transport roller 24 then transports the cut sheet form 100 through a transportation path defined by a guide plate 25, which is mounted opposite to the ink jet head 2. The cut sheet form 100 is then carried by another transport roller 26 through and out of a paper exit 27 at the back of the frame 5.

A transportation motor 28 mounted at the back side of the frame 5 powers the cut sheet transport mechanism 20. Torque from the transportation motor 28 is transferred through a gear set to a transportation roller shaft 29, and then by the transportation roller shaft 29 and another gear set on the opposite end to another transportation roller shaft 32.

The carriage 4 is thus driven bidirectionally through a predetermined printing area so that the ink jet head 2 mounted on the carriage 4 prints on the surface of the cut sheet form 100 transported to the printing position as described above. In printer 1 according to the present embodiment of the invention, the carriage 4 can also move outside the printing area to a position near the side wall 5*a* of the frame 5. The area outside the printing area includes a home position for the ink jet head 2, a cleaning position whereat cleaning of ink jet head 2 is performed, and a cut sheet form supply position whereat the automatic paper feeding mechanism 10 is driven to supply a form to the printing position.

A head capping mechanism 51, intake pump mechanism 52, and clutch mechanism 53 are disposed between the frame side wall 5*a* and the guide plate 25 defining the printing position. The head capping mechanism 51 serves to cap the nozzles of the ink jet head 2. The intake pump mechanism 52 is used for suctioning and collecting waste ink from the ink jet head 2 and head capping mechanism 51. The clutch mechanism 53 is used for connecting and disconnecting the power transfer mechanism 13 of the automatic paper feeding mechanism 10.

Figure 3:
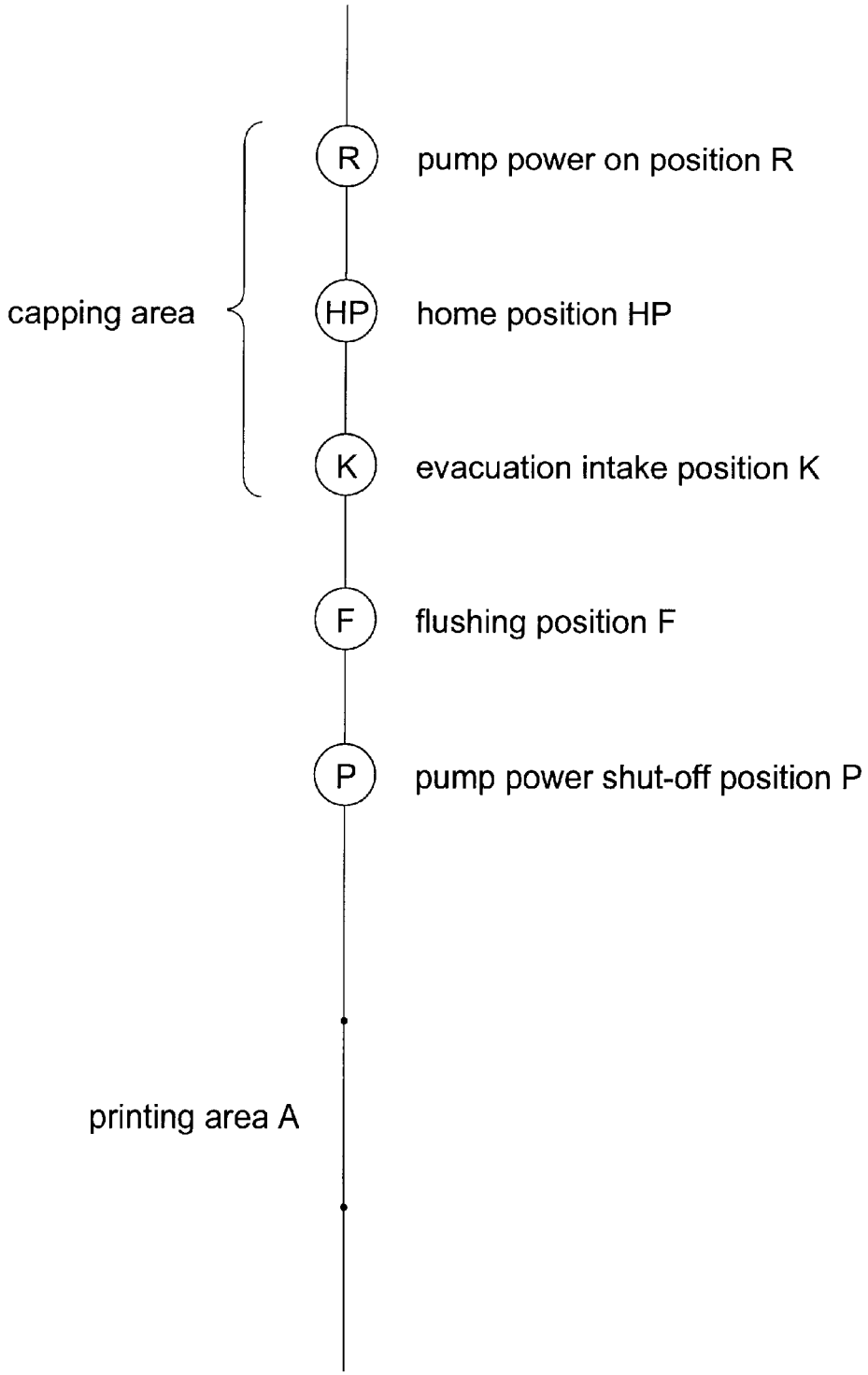
FIG. 3 is a descriptive illustration of the various positions at which ink jet head cleaning occurs in the printer shown in FIG. 1.

The positions whereat the ink jet head 2 (that is, the carriage 4) stops moving and the operations performed at each of these positions, are shown in FIG. 3 and described below. It should be noted that movement of carriage 4 can be detected by various known means, including a photosensor or a mechanical microswitch, and that carriage 4 can be stopped at each position based on the returned detection signals.

As shown in FIG. 3, the carriage 4 has a plurality of stopping positions arranged in sequence from the edge of the printing area A toward the side wall 5*a* of the frame 5. The stopping positions shown in FIG. 3 and described below are the pump power shut-off position P, the pre-eject or flushing position F, the evacuation intake position K, the home position HP, and the pump power-on position R.

Pump Power Shut-off Position P

This is the position at which drive power from the transportation motor 28 is switched from the intake pump mechanism 52 to the cut sheet transport mechanism 20 to stop intake pump mechanism 52 operation.

Flushing Position F

This is the position at which all nozzles of the ink jet head 2 are flushed by a preliminary ink ejection operation. Flushing ejects ink of which the viscosity has increased ("high viscosity ink" below) from any unused nozzles, for example. The nozzles of ink jet head 2 are located opposite to the head capping mechanism 51 in this position, and ink droplets flushed from the nozzles are captured by the head capping mechanism 51.

Evacuation Intake Position K

The nozzles of ink jet head 2 are capped by the head capping mechanism 51 in this position. This is where the intake pump mechanism 52 evacuates captured ink from the head capping mechanism 51.

Home Position HP This is the default position for the carriage 4, that is, this is where the carriage 4 is positioned after the power is turned on. The ink jet head 2 is also covered by the head capping mechanism 51 in this position.

Capping the nozzles prevents such problems as an increase in the viscosity of the ink as a result of evaporation of ink solvent from inside the nozzles and ink meniscus retraction. A cut-sheet form is supplied to the printing position after the carriage 4 is returned to the home position HP.

Pump Power-on Position R

This is the position at which drive power from the transportation motor 28 is switched from the cut sheet transport mechanism 20 to the intake pump mechanism 52 to enable operation of intake pump mechanism 52.

It should be noted that the ink jet head 2 is capped by the head capping mechanism 51 throughout the range from the evacuation intake position K to the pump power-on position R. As indicated in FIG. 3, this is referred to as the "capping area" below. Moreover, the operation performed at each of the above-described stopping positions is controlled by a controller, typically a CPU or equivalent.

Figure 4:
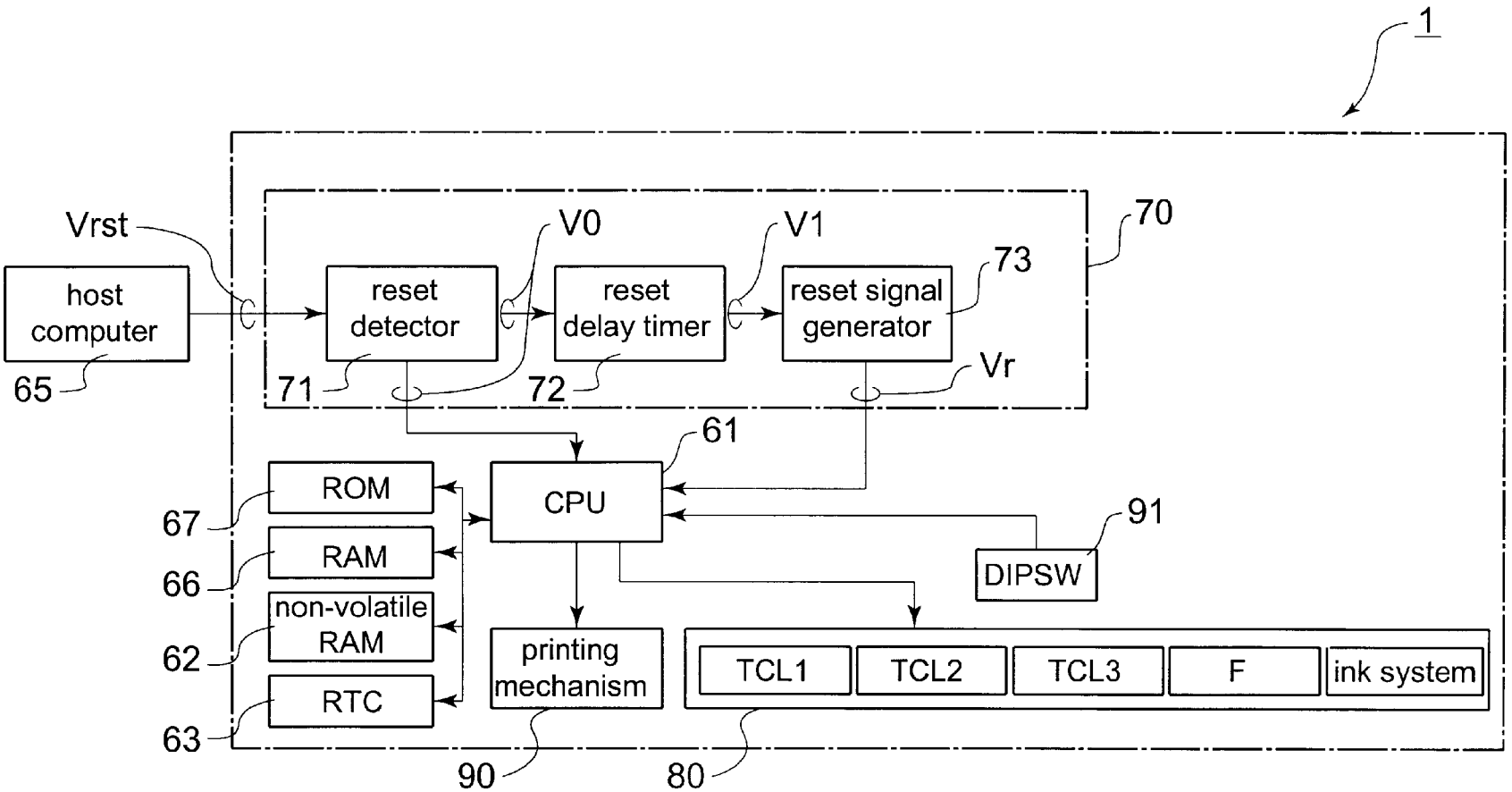
FIG. 4 is a block diagram of a control system in the printer shown in FIG. 1.

A block diagram of a printer 1 according to the present embodiment is shown in FIG. 4. As shown in FIG. 4, the printer 1 comprises a printing mechanism 90, the control device (CPU) 61, and a reset signal processing unit 70. The printing mechanism 90 includes a mechanism for moving the carriage 4, on which the ink jet head 2 is mounted, as described above, to a specific position. The CPU 61 controls the printing mechanism 90 and an ink system 80 described below. The reset signal processing unit 70 handles resetting the printer 1 based on a reset signal Vrst asserted from a host computer 65. When the reset signal Vrst is received, the reset signal processing unit 70 supplies an external reset signal V0 to the CPU 61 to notify the CPU 61 that a reset signal was received. After waiting a specific delay period T3 from receipt of the reset signal Vrst, the reset signal processing unit 70 then asserts an internal reset signal Vr to the CPU 61 to reset the CPU 61.

The printer 1 further comprises a non-volatile memory (non-volatile RAM) 62, a real-time clock (RTC) 63, a working memory (RAM) 66, and a ROM 67, each of which is connected to CPU 61. The non-volatile RAM 62 is typically an EEPROM or other non-volatile rewritable memory device for storing printer status information after the CPU 61 recognizes the external reset signal V0. This printer status information includes at least a cleaning history. The RTC 63 is a clock device whereby a current time value can be obtained. ROM 67 stores a control program described below.

The reset signal processing unit 70 thus receives a reset signal Vrst from a host computer 65, which is connected to the printer 1 by an interface cable or other device enabling printer-host communication, and then sequentially outputs an external reset signal V0 and internal reset signal Vr. When the CPU 61 is notified of the reset signal Vrst from the host computer 65, it loads the control program from ROM 67 to working RAM 66 in order to control the printer 1 based on the status history written to the non-volatile RAM 62.

Based on the information read from ROM 67 and non-volatile RAM 62, the CPU 61 instructs the ink system 80 to perform one of plural cleaning operations, which differ by the amount of ink consumed. In the present embodiment there are five ink consumption or cleaning levels defined as: cleaning level 1 (TCL1), cleaning level 2 (TCL2), cleaning level 3 (TCL3), flushing F, and dummy cleaning. The amount of ink consumed increases in the following sequence: dummy cleaning, flushing F, TCL1, TCL2, TCL3. Note that no ink is consumed in the dummy cleaning process.

The cleaning processes performed at cleaning levels TCL1, TCL2, and TCL3 include: a process for suctioning ink from the nozzles to remove high viscosity ink and bubbles from the ink path; a so-called wiping process in which the head surface is cleaned by wiping with a rubber blade; and a so-called rubbing process in which the head surface is wiped with a sponge as may be further required. The specific content of, and conditions for selecting, each of these cleaning levels are described briefly next below.

Cleaning Level 1 (TCL1)

If, based on cleaning history information read from the non-volatile RAM 62, less than 96 hours have elapsed since the ink jet head 2 was last cleaned at TCL1 or higher, and 15 hours or more have elapsed since the ink jet head 2 was set to a stand-by mode, that is, since the ink jet head 2 was uncapped, TCL1 is selected. During the TCL1 cleaning process, all ink inside an ink ejection chamber of ink jet head 2 is suctioned, and a known amount of ink is therefore consumed. For purposes of comparison, ink consumption at TCL1 has a (relative) volume of 1.

Cleaning Level 2 (TCL2)

TCL2 is selected if 96 hours or more and less than 168 hours have elapsed since the last cleaning operation at TCL1. This is again decided based on the cleaning history read from non-volatile RAM 62. The TCL2 cleaning process suctions all ink from inside the head unit. Ink consumption has a volume of 8 in this case.

Cleaning Level 3 (TCL3)

TCL3 is selected if 168 hours or more have elapsed since the last cleaning operation at TCL1. This is also decided on the cleaning history read from nonvolatile RAM 62. The TCL3 cleaning process suctions all ink from inside the ink path. Ink consumption has a volume of 40,in this case. This cleaning process consumes the most ink in printer 1.

Flushing F

The flushing F process is selected if less than 15 hours have elapsed since the ink jet head 2 was uncapped. The flushing F process pumps the nozzles 40 to 1000 times to simply eject ink from and near the nozzles. Ink consumption has a volume of 0.0025 to 0.06 in this case.

Dummy Cleaning

After flushing F, dummy cleaning wipes the head surface, caps the head, and evacuates captured ink, but does not by itself consume ink. In a preferred embodiment of the invention, this dummy cleaning can be enabled and disabled by means of a DIP switch 91.

In an exemplary printer 1, the printing mechanism 90 is also initialized as part of these cleaning processes. Note that this initialization includes moving the carriage 4 to the home position HP.

As also shown in FIG. 4, the reset signal processing unit 70 comprises a reset detector 71, reset delay timer 72, and a reset signal generator 73. When the reset detector 71 detects the reset signal Vrst among the signals received from the host computer 65, it outputs the external reset signal V0. The reset delay timer 72 outputs a delayed reset signal V1 after waiting a specific delay period from input of the external reset signal V0. When the reset signal generator 73 receives the delayed reset signal V1 it sends the internal reset signal Vr to the CPU 61. The reset signal generator 73 generates a reset signal suitable for CPU 61, namely pulse width, rising time of pulse, falling time of pulse, and voltage. This internal reset signal Vr causes the CPU 61 to perform the same initialization process performed when the power switch of the printer 1 is turned on. Asserting the internal reset signal Vr to the CPU 61 thus causes an initialization process including initializing the printing mechanism 90, and initialization of the program and data cleanup in the working RAM 66.

Figure 5:
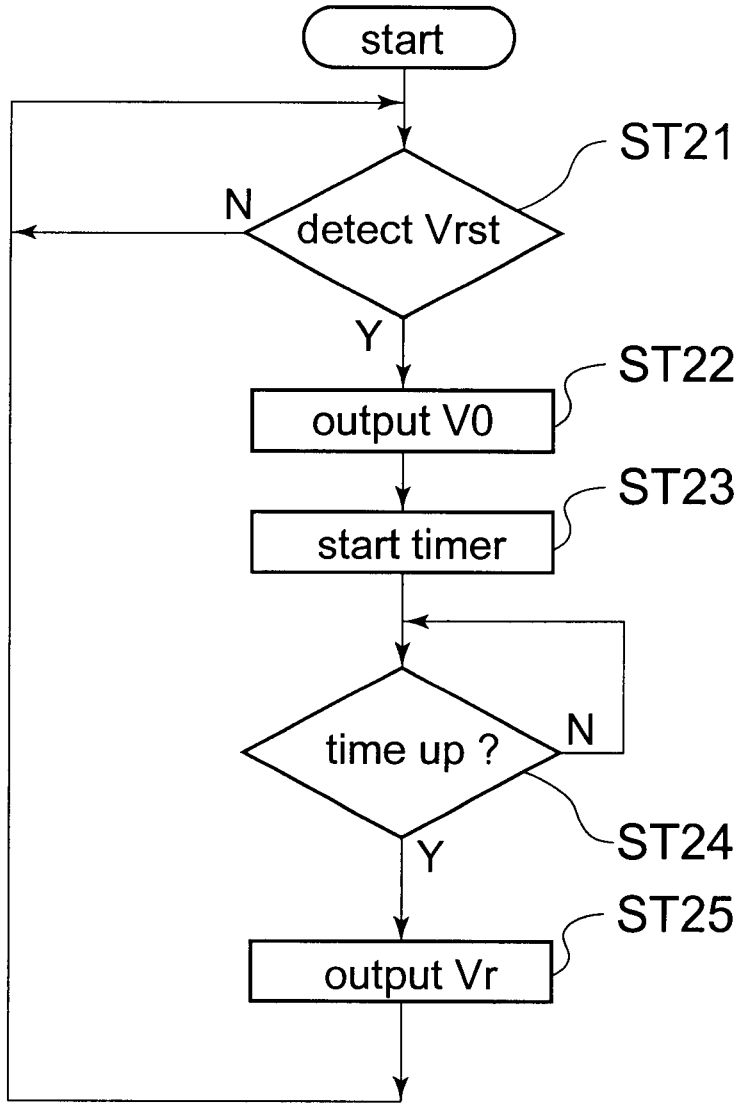
FIG. 5 is a flow chart of the reset signal process in the printer shown in FIG. 1.

FIG. 5 is a flow chart of the process from receiving the reset signal Vrst from the host computer to the output of the internal reset signal Vr to the CPU 61. As shown in FIG. 5, when the reset detector 71 detects the reset signal Vrst (step ST21), it outputs the external reset signal V0 (step ST22). Triggered by the external reset signal V0, the reset delay timer 72 then starts (step ST23). When a predetermined period has passed, reset delay timer 72 outputs the delayed reset signal V1 (step ST24) to the reset signal generator 73. The reset signal generator 73 then sends the internal reset signal Vr to the CPU 61 (step ST25).

The reset detector 71 outputs the external reset signal V0 to the reset delay timer 72 and to the CPU 61. As noted above, the external reset signal V0 triggers operation of reset delay timer 72. During the predetermined delay period after the reset delay timer 72 is triggered, the internal reset signal Vr is not supplied from the reset signal generator 73 to the CPU 61. Note that this predetermined delay period is 100 ms in an exemplary embodiment of the invention. The external reset signal V0, however, is applied to the CPU 61 at the same time it is sent to the reset delay timer 72. As a result, the CPU 61 is notified that a reset signal Vrst has been received from the host computer 65.

The CPU 61 thus has a grace period between when it is notified that a reset signal Vrst has been received (that is, when the external reset signal V0 is received from the reset detector 71) and when the internal reset signal Vr is received. This grace period is used for the CPU 61 to record certain information to the non-volatile RAM 62, including for example, printer status information and information that a reset signal Vrst was received. Printer status information includes, for example, the following: status information relating to mechanical components, including the carriage position and ink cartridge presence; current time; an ink end counter value indicative of how much ink remains; and information relating to the cleaning process performed during the reset operation.

It will be apparent from the foregoing description to one with ordinary skill in the art that the CPU 61 can store printer status information to the non-volatile RAM 62 independently of any timing referenced to this external reset signal V0, including, for example, periodically at a predetermined time interval or after a cleaning process. In this case, the time each cleaning process was performed can be recorded for each cleaning level, or can be recorded for only specific cleaning levels. For example, the time could be recorded only when cleaning at TCL1 or higher is performed. Status information recorded at a regular interval can also include, for example, the time when the nozzles were uncapped, and a print pass counter indicative of the print volume. If a reset signal Vrst is detected during status information recording at a specific interval or after a cleaning process is completed, it is still possible to finish recording the status information in the grace period before the internal reset signal Vr is received.

Figure 6:
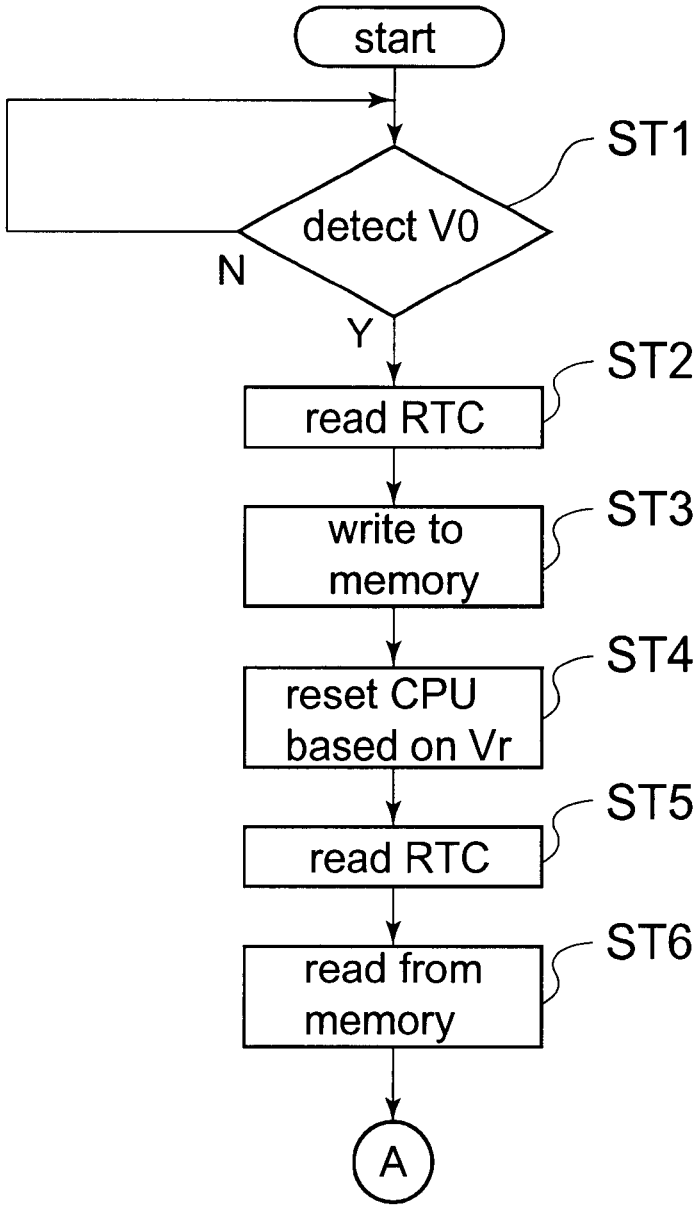
FIG. 6 is a flow chart of the operation of the control system shown in FIG. 4.
Figure 7:
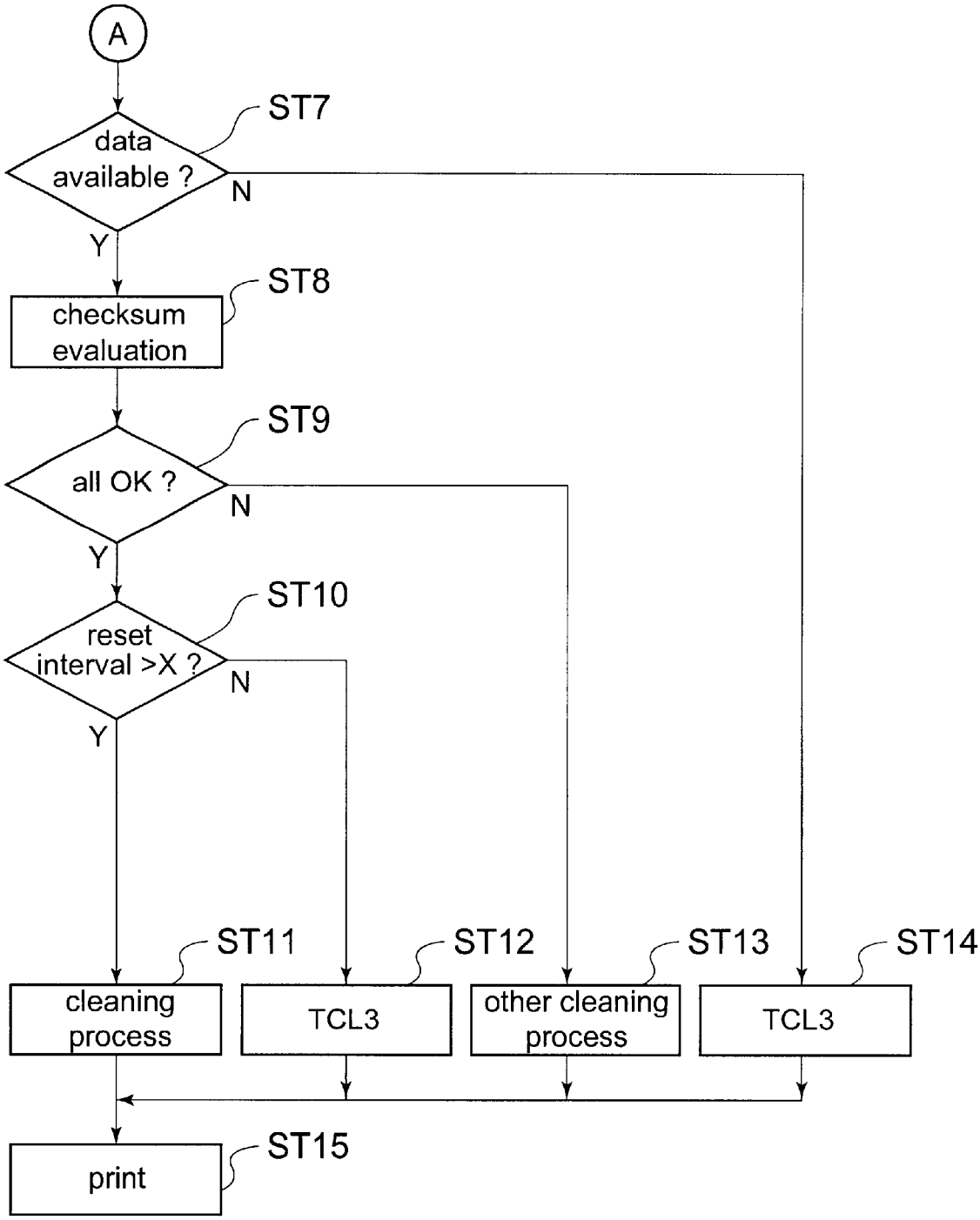
FIG. 7 is a flow chart of the operation after the control operation shown in FIG. 6.
Figure 8:
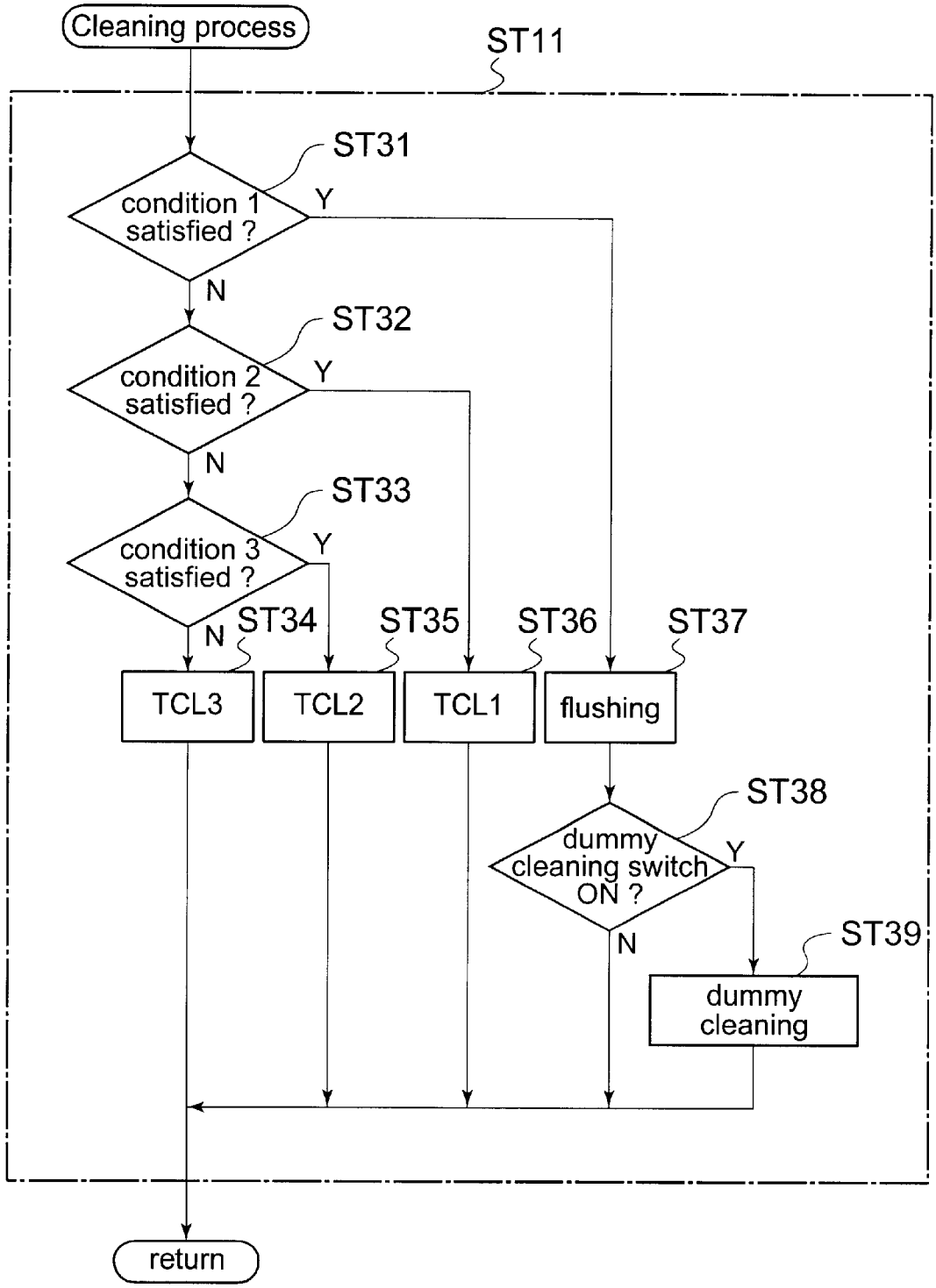
FIG. 8 is a flow chart of the cleaning process control operation shown as step ST11 in FIG. 7.

FIGS. 6 to 8 are flow charts used below to describe the cleaning processes of a printer 1 according to the preferred embodiment of the present invention.

Referring to FIG. 6, when the CPU 61 detects the external reset signal V0 applied by reset detector 71 (step ST1), CPU 61 reads the current time from the RTC 63 as the reset time (step ST2), and then writes the printer status information to non-volatile RAM 62 (step ST3). When CPU 61 then detects the internal reset signal Vr, the printer 1 is reset according to the same reset procedure performed when the power switch is turned on (ST4). As a result of this, an initialization process is performed. In the first step in this process, ST5, the CPU 61 reads the current time from RTC 63 (ST5). Then it reads the printer status information from non-volatile RAM 62 (step ST6).

Referring to FIG. 7, CPU 61 then determines whether the required information is recorded to non-volatile RAM 62 (step ST7). If the CPU 61 is not functioning normally for some reason, or the status information could not be written to the non-volatile RAM 62 due to some problem, the procedure branches to step ST14. The initialization level cleaning process (TCL3) is then performed (step ST14) as described above, and printing occurs in step ST15.

If the required information was successfully read (ST7 returns YES), inspection information is checked, that is, a checksum operation is performed (step ST8). The result of the checksum operation is then evaluated (step ST9). If, because of some problem, data writing to non-volatile RAM 62 could not be completed within the delay period generated by the reset delay timer 72, or if there is an error in the history data (ST9 returns NO), control moves to step ST13. At step ST13 the cleaning history is checked for any block in which the inspection information is normal (in which no error is detected), and an appropriate cleaning level is selected. For example, if the time or level of the last cleaning operation is not recorded, or if some of the information is valid but the status of the last cleaning operation is not known, TCL3 is selected and performed. When the selected cleaning process is completed, printing occurs in step ST15.

If all checksum values are normal and step ST9 returns YES, the interval between the reset time at which the last external reset signal V0 was input and the time at which the current external reset signal V0 was input is compared with a specific value X (step ST10). Note that this interval is indicated as (t2–t9) in FIG. 9.

If this reset interval is less than X (for example, the reset interval is several seconds), it is assumed that the user is purposefully instructing a full reset operation, that is, wishes an initialization level cleaning process (TCL3) to be performed. The procedure therefore branches to ST12, and TCL3 is performed. Printing then occurs in step ST15.

Figure 9:
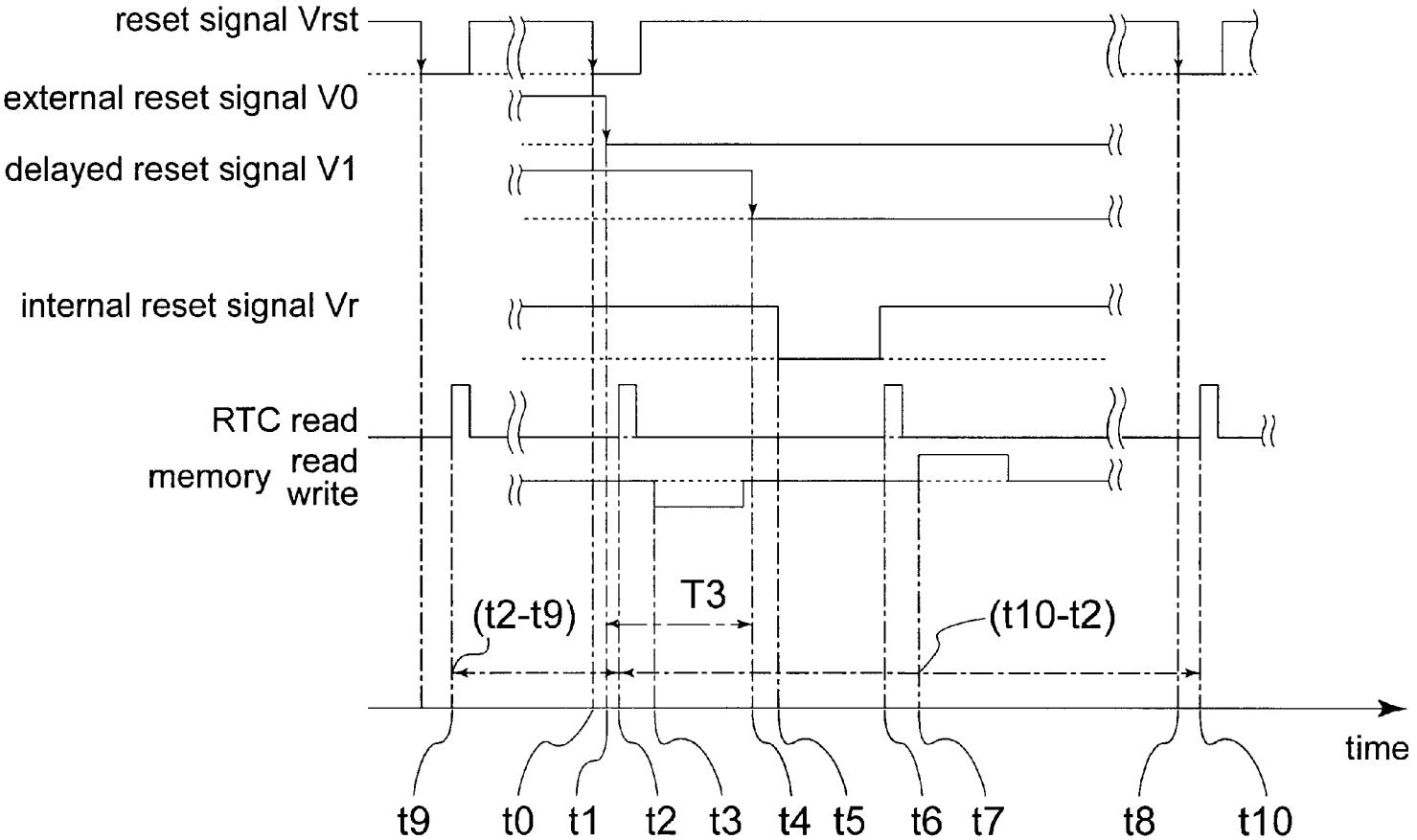
FIG. 9 is a timing chart used to describe the operation whereby the control system shown in FIG. 4 normally writes cleaning history information to memory.

If the reset interval is sufficiently long ((t10–t2) in FIG. 9) in ST10, an appropriate cleaning level is selected in step ST11. Printing then occurs in step ST15.

A process for selecting an appropriate cleaning level in step ST11 is shown in FIG. 8.

The interval between the time of the last cleaning operation read from non-volatile RAM 62 and the time of the last reset read from the RTC 63 after resetting, and the interval between the reset time read from the non-volatile RAM 62 and the time of the last reset read from RTC 63, are first calculated in step ST31. These calculated intervals are then used to determine whether condition 1 is fulfilled, that is, whether the time elapsed since cleaning at TCL1 or higher is less than 96 hours and the time during which the ink jet head has been uncapped is less than 15 hours. If condition 1 is fulfilled, the procedure branches to step ST37. The carriage 4 is then moved to the flushing position F, and the ink jet head 2 is cleaned using the flushing process (step ST37). The status of the dummy cleaning DIP switch 91 is then detected in step ST38. If and only if dummy cleaning is enabled, the dummy cleaning process is also performed (step ST39) before printing (step ST15). If dummy cleaning is not enabled, printing (step ST15) begins after flushing is finished.

If condition 1 is not met in step ST31, it is determined whether a condition 2 is fulfilled, that is, whether the time elapsed since cleaning at TCL1 or higher is less than 96 hours and the time during which the ink jet head has been uncapped is 15 hours or more (step ST32). If condition 2 is met, the ink jet head is cleaned at TCL1, that is, the cleaning level with the next to least ink consumption (step ST36). Printing then begins after TCL1 cleaning is completed (step ST15).

If condition 2 is not met in step ST32, it is determined whether a condition 3 is fulfilled, that is, whether the time elapsed since cleaning at TCL1 or higher is between 96 and 168 hours (step ST33). If condition 3 is met, the ink jet head is cleaned at TCL2, that is, the cleaning level with the second highest ink consumption (step ST35). Printing then begins after TCL2 cleaning is completed (step ST15).

If condition 3 is not met in step ST33, that is, more than 168 hours have elapsed since a cleaning operation at TCL1 or higher, the ink jet head is cleaned at TCL3, that is, the cleaning level with the highest ink consumption (step ST34). Printing then begins after TCL3 cleaning is completed (step ST15).

FIG. 9 is a timing chart of the operation when the cleaning history information is written correctly to the non-volatile RAM 62. When the reset detector 71 detects a reset signal Vrst at time t0, it outputs external reset signal V0 to CPU 61 and reset delay timer 72 at time t1. This external reset signal V0 triggers CPU 61 to read time t2 as the reset time and store the printer status information to non-volatile RAM 62 at time t3.

When reset delay timer 72 times out after counting delay period T3, it supplies delayed reset signal V1 to reset signal generator 73. When the operation is normal, writing to non-volatile RAM 62 can be accomplished within delay period T3. When the delayed reset signal V1 is input to reset signal generator 73, it outputs the internal reset signal Vr to CPU 61 at time t5. This internal reset signal Vr causes the CPU 61 to reset. In the initialization process, the CPU 61, after being reset, reads current time t6 from RTC 63 and then reads the required information from non-volatile RAM 62 at time t7. The appropriate cleaning level is then selected based on the read information.

Figure 10:
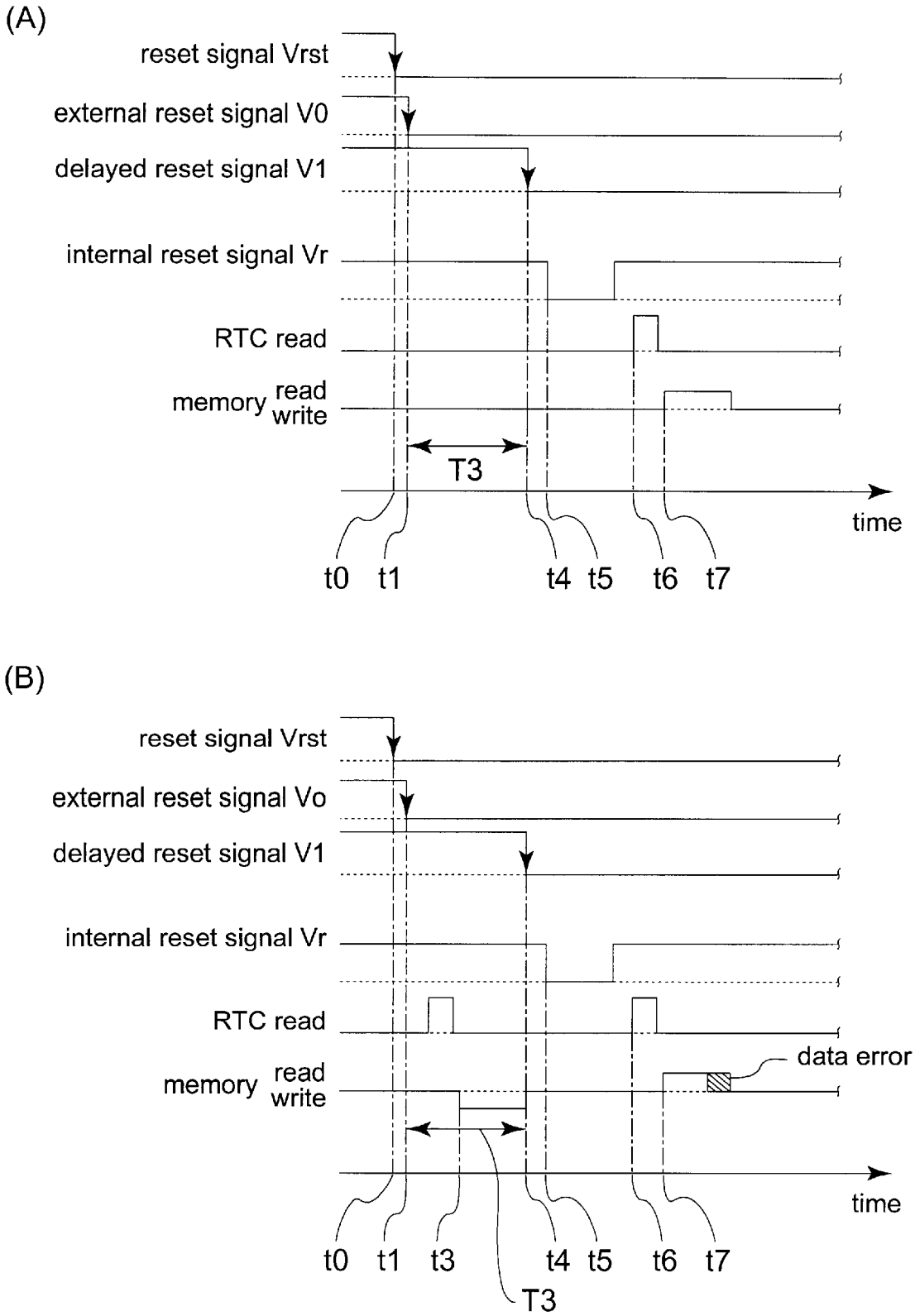
FIG. 10 is a timing chart used to describe the operation whereby the control system shown in FIG. 4 does not normally write cleaning history information to memory.

Timing charts of the operation when the cleaning history information is not written or not correctly written to the non-volatile RAM 62 are shown in FIGS. 10A and 10B, respectively.

As described above, cleaning at TCL3 is performed in step ST14 (FIG. 7) when it is determined in step ST7 that the information read from non-volatile RAM 62 is not appropriate, that is, that the CPU 61 was not functioning normally or that the cleaning history information was not written correctly to the non-volatile RAM 62 for some reason. FIG. 10A is a timing chart for a sequence in which internal reset signal Vr is output without information being read from RTC 63 and non-volatile RAM 62.

The cleaning history information blocks determined by the checksum operation to be normal are detected and an appropriate cleaning process is selected in step ST13 (FIG. 7), as described above, when in ST9 it is determined that writing the history information could not be completed within delay period T3, or that there is an error in part of the information. FIG. 10B is a flow chart of an operation for this case. In this case, information is read from RTC 63 and non-volatile RAM 62 in the same manner as when the information stored to non-volatile RAM 62 is normal.

A further cleaning level is provided in the present invention to handle those cases in which the nozzles of ink jet head 2 are not capped when a subsequent reset signal is received. This makes it possible to separately control the cleaning process based on whether or not the nozzles are capped when reset signals are successively received. Compared to the situation when the nozzles are capped, the viscosity of ink in the nozzles is typically higher when the nozzles are uncapped immediately before a reset command is received. This makes it preferable to provide another cleaning level in addition to the normal cleaning levels for use in such cases. A cleaning level for use when the nozzles are not capped when a reset is requested, referred to below as uncapped cleaning, can be provided by, for example, increasing the number of wiping or rubbing operations, or changing the selection conditions for one or more normal cleaning levels. In the present embodiment, for example, cleaning levels for uncapped cleaning are achieved by shortening the interval from the last cleaning operation at TCL1 or higher.

Figure 11:
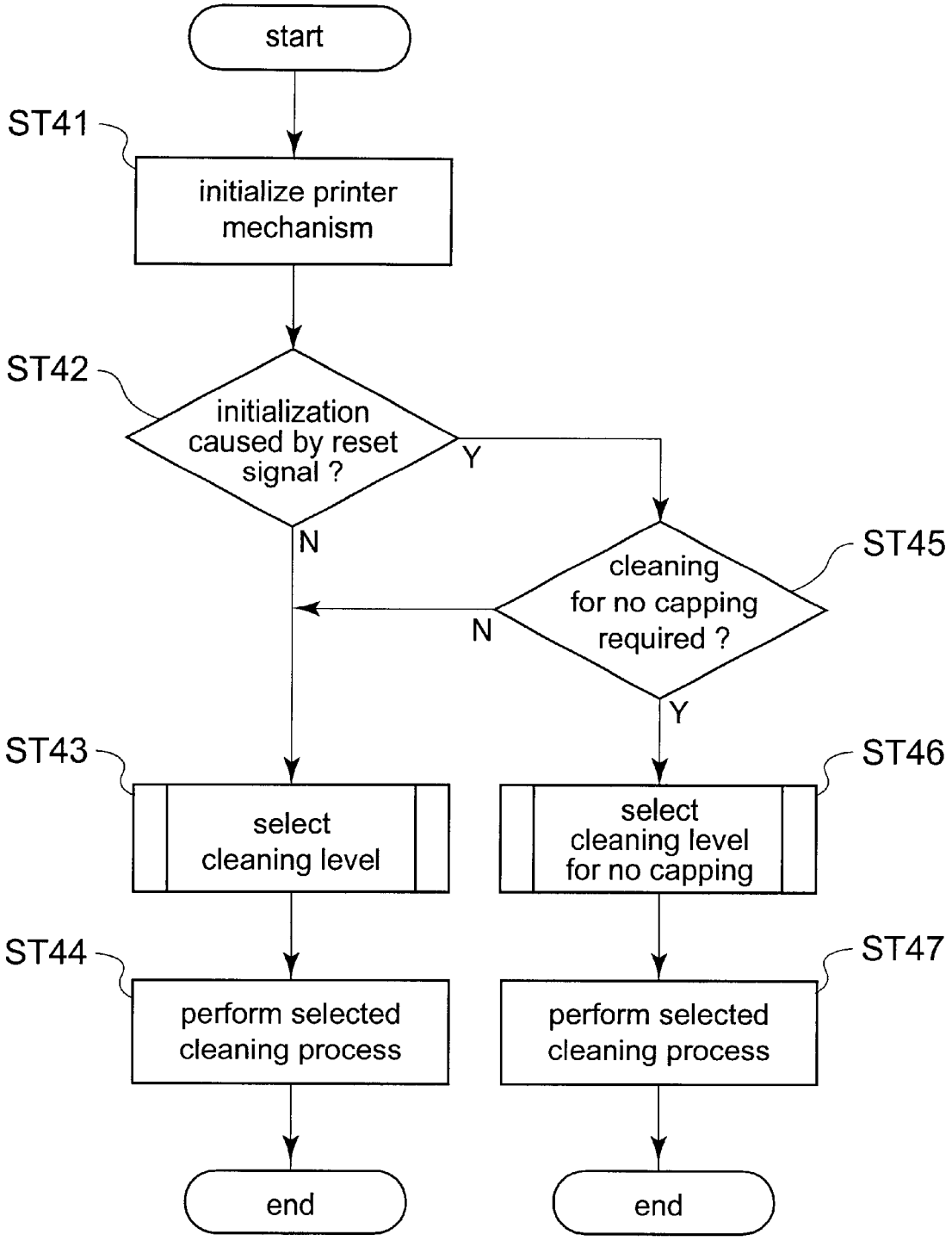
FIG. 11 is a flow chart used to describe an operation whereby different cleaning levels are used when the head nozzles are not capped in a printing apparatus according to the present invention.

FIG. 11 is a flow chart of a control process for this case. Note that this flow chart includes a step for printer initialization when the power switch is turned on. When a reset signal is sent to the CPU 61, the printing mechanism 90 is initialized (step ST41). In step ST42, it is determined whether the reset signal is an internal reset signal Vr generated in response to a reset signal Vrst from the host computer 65, or is a reset signal generated because the power switch was turned on. As noted above, this determination can be made by reading the status information stored to the non-volatile RAM 62.

If the reset signal is a power-on generated signal, the procedure advances to step ST43 for cleaning process selection. This selection chooses flushing or cleaning levels 1 to 3 (TCL1–TCL3) based on the status information from non-volatile RAM 62 and the conditional evaluations described with reference to the flow chart in FIG. 8. The selected cleaning operation is then performed in step ST44.

However, if the reset signal sent to the CPU 61 is generated in response to the reset signal Vrst (step ST42 returns YES), it is determined whether uncapped nozzle cleaning is required (step ST45). This determination can be made based on the time elapsed from the time of the last power-on reset. For example, if the elapsed time is more than one second, it can be determined that uncapped cleaning is needed. The appropriate cleaning level meeting specific cleaning conditions defined for when the head is not capped can then be selected (step ST46), and the selected cleaning operation performed (step ST47).

These cleaning levels can be the same as the regular cleaning levels described above while simply changing the selection conditions. For example, TCL1 may be selected for uncapped cleaning when the time since the last cleaning operation at TCL1 or higher is less than 12 hours; TCL2 may be selected when the elapsed time is between 12 and 84 hours; and TCL3 may be selected when the elapsed time is 84 hours or more. Note that as in step ST43, the elapsed time can be calculated by referencing the information stored to non-volatile RAM 62.

When a reset signal Vrst is asserted from a host computer 65 to a printer 1 according to a preferred embodiment of the present invention as described above, an external reset signal V0 is first applied to the CPU 61 and then an internal reset signal Vr is applied after a predetermined delay period. As a result, the CPU 61 has a chance to write the status of the printer 1 at the time the external reset signal V0 was received, as well as the past cleaning history, to non-volatile RAM 62 before the printer 1 is reset. This enables the information stored to non-volatile RAM 62 to be referenced during the initialization process following printer 1 resetting so that the ink jet head 2 can be cleaned using a cleaning level appropriate to the condition of ink in the head.

It is therefore possible to perform a cleaning process appropriate to the interval between the reset signals when a reset signal Vrst is asserted by the host computer 65 at short intervals. It is therefore possible to avoid cleaning the print head at the initialization level, that is, at TCL3 in the above description, every time a reset signal is received. Consumption of excessively large amounts of ink can thus be prevented.

It should be noted that the external reset signal V0 is preferably applied to the Non Maskable Interrupt (NMI) pin of the CPU 61. With this arrangement, the CPU 61 can certainly recognize the external reset signal V0. The internal reset signal Vr is also preferably applied to the reset RST pin of the CPU 61. With this arrangement, the CPU 61 can certainly execute reset operation in response to the external reset signal Vrst.

In addition, cleaning at the initialization level is forced in a printer 1 according to the present embodiment when the interval between reset times is less than a predetermined time X. This makes it possible to force the printer 1 to perform the cleaning operation by successive reset signals output purposefully by the user such as when there is a need for cleaning.

When all or just part of the historical information could not be written to the non-volatile RAM 62 within the allotted delay period, a printer 1 according to the present embodiment can still determine the appropriate cleaning level as much as possible based on whatever historical information is valid by individually checking the validity of each item of historical information. It is therefore possible to reduce ink consumption as much as possible, while also avoiding loss of print quality due to deficient cleaning, because the appropriate cleaning level is determined based only on historical information detected to be valid.

As will be understood from the foregoing description, after the flushing process, a printer 1 according to the present embodiment can perform a dummy cleaning process that is substantially the same as the initialization level cleaning process but without consuming any ink. The user can thus be made clearly aware that the printer 1 received and executed reset signal Vrst even though initialization level cleaning is not actually performed. The user can thus be prevented from worrying unnecessarily that head cleaning was not performed.

As will also be understood from the foregoing description, whether this dummy cleaning process is performed or not can be controlled by means of a preferably externally accessible DIP switch 91 on the printer 1. The user can thus choose whether to enable the dummy cleaning process.

While non-volatile RAM is used for storing historical information in a preferred embodiment of the present invention, it will be understood by those skilled in the art that a hard disk or other type of non-volatile storage device can be used.

Furthermore, while a DIP switch is used for enabling and disabling the dummy cleaning process, the invention is not limited thereto. A control command sent from the host computer, for example, can also be used.

In a preferred embodiment of the invention the cleaning level used after a reset operation is determined by reading information stored in non-volatile RAM 62, and referencing the carriage standby time and time elapsed since the last cleaning operation at TCL1 or higher. It is also possible, however, to reference other status information to conditionally select the appropriate cleaning level. The cleaning level can be conditionally selected, for example, based on a print pass counter indicative of the print volume, and the time elapsed since the last cleaning operation at TCL1 or higher. If a reset operation is effected during cleaning, it is alternatively possible to reference information about the cleaning operation in progress when the reset was effected, and perform a cleaning operation of the same level or higher.

In addition, it is not always necessary to obtain the reset time in a printer 1 according to a preferred embodiment of the invention, and this step can be specifically omitted when there is little chance of successive reset signals. On the other hand, when there is a chance of frequent resets being generated by the software applications, for example, reading the time from the RTC 63 is unnecessary immediately after resetting. In this case, it is sufficient to read the time from the RTC 63 when reading data from the non-volatile RAM 62.

It will be understood that while the elapsed time from the last cleaning operation is determined by reading the current time from the RTC 63, the current time is not always necessary insofar as the time since the last cleaning operation can be determined. For example, the elapsed time can be determined by having the control device restart an RTC or other clock device after each cleaning operation to measure the time between cleaning operations.

The present invention has been described as recording to non-volatile memory information related to the cleaning process in progress when a reset is effected during cleaning. When the next cleaning operation is selected, however, it is also possible to select a cleaning level of the same or stronger level, and thereby prevent a loss of print quality and other associated problems resulting from an insufficient cleaning process being selected.

A printing apparatus and control method for resetting the printing apparatus according to the present invention can thus perform a process identical to the power-on reset operation when a reset is requested from a host computer. That is, when a reset signal is received, various printer status information is written to nonvolatile memory and a hardware reset is then performed to assure operational reliability. After the reset, the information written to a non-volatile memory is then read to perform the appropriate process. It is therefore possible for head cleaning, parts replacement, and other maintenance tasks to be appropriately performed, and thus achieve a high reliability printing apparatus.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printing apparatus in communication with a host computer for printing to a printing medium based on data received from the host computer, said printing apparatus comprising:

means for storing printing apparatus status information;

means for controlling printing apparatus operation, including writing and reading the printing apparatus status information to and from said storing means, and effecting an initialization process based on a reset signal generated by the host computer or by printing apparatus power on operation; and means for receiving the reset signal from the host computer, applying an external reset signal to said controlling means to inform said controlling means that the reset signal was received, and then applying an internal reset signal to said controlling means after a predetermined time delay from applying the external reset signal;

wherein said controlling means writes at least the printing apparatus status information required for the initialization process to said storing means during the predetermined time delay in response to the external reset signal, and effects the initialization process in response to the internal reset signal.

2. The printing apparatus as set forth in claim 1, wherein the printing apparatus status information written to said storing means includes information that the external reset signal was received.

3. A printing apparatus comprising:

an ink jet head cleaning mechanism;

means for storing printing apparatus status information;

means for controlling printing apparatus operation, including writing and reading the printing apparatus status information to and from said storing means, and controlling said cleaning mechanism using at least one of a plurality of process levels, each consuming a different amount of ink; and means for receiving a reset signal from an external source, applying an external reset signal to said controlling means to inform said controlling means that the reset signal was received, and then applying an internal reset signal to said controlling means after a predetermined time delay from applying the external reset signal, the internal reset signal being the same as the reset signal applied when printing apparatus power is turned on;

wherein said controlling means writes the printing apparatus status information to said storing means during the predetermined time delay in response to the external reset signal, and, in response to the internal reset signal, reads the printing apparatus status information written to said storing means, selects at least one of the plurality of process levels based on the read information, and controls said cleaning mechanism according to the at least one selected process level.

4. The printing apparatus as set forth in claim 3, wherein the plurality of process levels include a dummy cleaning process, which consumes no ink and is otherwise substantially the same operation as an initialization level cleaning process in which a specific amount of ink is consumed.

5. The printing apparatus as set forth in claim 4, further comprising means for selectively enabling or disabling the dummy cleaning process.

6. The printing apparatus as set forth in claim 3, wherein the status information includes time information indicative of when cleaning at a specific process level was last performed, and wherein said controlling means calculates an elapsed time since the last cleaning at that specific process level based on the written time information and the current time, selects the at least one process level according to the elapsed time, and controls the cleaning mechanism according to the at least one selected process level.

7. The printing apparatus as set forth in claim 6, wherein the status information includes the time at which the external reset signal was applied, this time being used as the current time for calculating the elapsed time.

8. The printing apparatus as set forth in claim 3, wherein the status information includes the time at which the ink jet head is uncapped.

9. The printing apparatus as set forth in claim 3, wherein said controlling means selects and implements cleaning at an initialization level in which a specific amount of ink is consumed when the status information is not stored or the stored status information is invalid.

10. The printing apparatus as set forth in claim 3, wherein after the predetermined time delay, said receiving means outputs the internal reset signal.

11. The printing apparatus as set forth in claim 3, wherein said controlling means writes the status information to said storing means at a given time interval.

12. The printing apparatus as set forth in claim 3, wherein the status information includes the time period elapsed since the ink jet head was uncapped.

13. The printing apparatus as set forth in claim 11, wherein the status information includes a print pass counter indicative of the printing volume.

14. The printing apparatus as set forth in claim 3, wherein said controlling means, after each cleaning process, writes the time of the cleaning process to said storing means.

15. A printing apparatus comprising:

an ink jet head cleaning mechanism;

means for storing printing apparatus status information;

means for controlling printing apparatus operation, including writing and reading the printing apparatus status information to and from said storing means, and controlling said cleaning mechanism using at least one of a plurality of process levels, each consuming a different amount of ink; and means for receiving a reset signal from an external source, applying an external reset signal to said controlling means to inform said controlling means that the reset signal was received, and then applying an internal reset signal to said controlling means after a predetermined time delay from applying the external reset signal, the internal reset signal being the same as the reset signal applied when printing apparatus power is turned on;

wherein said controlling means writes the printing apparatus status information to said storing means during the predetermined time delay, and, after the internal reset signal is applied, reads the printing apparatus status information written to said storing means, selects at least one of the plurality of process levels based on the read information, and controls said cleaning mechanism according to the at least one selected process level; and wherein the status information is comprised of a plurality of status information units and validation information for each unit, wherein said controlling means selects the at least one process level based on the status information in the unit or units for which the validation information, obtained from a validation check operation performed on the corresponding status information, indicates that the corresponding status information was properly written to and stored in said storing means during the predetermined time delay, and controls the cleaning mechanism according to the at least one selected process level.

16. The printing apparatus as set forth in claim 11, wherein, when an error is detected in the status information read from said storing means, said controlling means selects and implements cleaning at an initialization level in which a specific amount of ink is consumed.

17. A control method for resetting a printing apparatus that includes a memory for storing printing apparatus status information, and a controller for controlling printing apparatus operation, including writing and reading information to and from the memory, said control method comprising the steps of:

receiving a reset signal generated by an external source or by printing apparatus power on operation;

applying to the controller an external reset signal to inform the controller that the reset signal was received;

applying an internal reset signal to the controller after a specific delay from applying the external reset signal;

writing to the memory at least the printing apparatus status information during the specific delay in response to the external reset signal;

reading the printing apparatus status information in response to the internal reset signal; and effecting an initialization process based on the read printing apparatus status information in response to the internal reset signal.

18. The control method as set forth in claim 17, wherein the printing apparatus status information written to the memory includes information that the external reset signal was received.

19. A control method for resetting a printing apparatus that includes a memory for storing printing apparatus status information, and a controller for controlling printing apparatus operation, including writing and reading information to and from the memory, said control method comprising the steps of:

initializing an ink jet head cleaning mechanism, and controlling the cleaning mechanism using one of a plurality of process levels, each consuming a different amount of ink;

receiving a reset signal, and applying to the controller an external reset signal to inform the controller that the reset signal was received;

writing the printing apparatus status information to the memory in response to the external reset signal;

applying an internal reset signal to the controller after a specific delay from applying the external reset signal, the internal reset signal being the same as the reset signal applied when printing apparatus power is turned on;

reading the printing apparatus status information written to the memory in response to the internal reset signal, and selecting at least a specific one of the plurality of process levels based on the read information in response to the internal reset signal; and controlling the cleaning mechanism according to the at least one selected specific process level.

20. The control method as set forth in claim 19, further comprising the step of:

performing a dummy cleaning process following the cleaning mechanism control step, the dummy cleaning process consuming no ink and otherwise being substantially the same operation as an initialization level cleaning process in which a specific amount of ink is consumed.

21. The control method as set forth in claim 19, wherein said process level selection step comprises determining whether the dummy cleaning process is performed.

22. The control method as set forth in claim 19, wherein the status information includes the time at which the ink jet head is uncapped.

23. The control method as set forth in claim 19, wherein the process level selection step comprises cleaning at an initialization level in which a specific amount of ink is consumed when the status information is not stored or the stored status information is invalid.

24. The control method as set forth in claim 19, wherein the internal reset signal applying step is performed after an amount of time required to write the printing apparatus status information to the memory has lapsed.

25. The control method as set forth in claim 19, wherein the status information includes time information indicative of when cleaning at a specific process level was performed, and wherein said process level selection step comprises calculating an elapsed time since the last cleaning process at that specific process level based on the time information and a current time, and selecting the at least one process level according to the elapsed time.

26. The control method as set forth in claim 25, wherein the status information includes the time at which the external reset signal was applied, this time being used as the current time for calculating the elapsed time.

27. A control method for resetting a printing apparatus that includes a memory for storing printing apparatus status information, and a controller for controlling printing apparatus operation, including writing and reading information to and from the memory, said control method comprising the steps of:

initializing an ink jet head cleaning mechanism, and controlling the cleaning mechanism using one of a plurality of process levels, each consuming a different amount of ink;

receiving the reset signal, and applying to the controller an external reset signal to inform the controller that the reset signal was received;

writing the printing apparatus status information to the memory;

applying an internal reset signal to the controller after a specific delay from applying the external reset signal, the internal reset signal being the same as the reset signal applied when printing apparatus power is turned on;

reading the printing apparatus status information written to the memory, and selecting at least a specific one of the plurality of process levels based on the read information; and controlling the cleaning mechanism according to the at least one selected specific process level;

wherein the status information is comprised of a plurality of status information units and validation information for each unit; and wherein the process level selection step comprises selecting the at least one process level based on status information in the unit or units for which the validation information, obtained from a validation check operation performed on the corresponding status information, indicates that the corresponding status information was properly written to and stored in the memory.

28. The control method as set forth in claim 27, wherein the process level selection step comprises selecting cleaning at an initialization level in which a specific amount of ink is consumed when an error is detected in the status information read from the memory.

29. The printing apparatus as set forth in claim 1, wherein said controller writes the status information to said memory at a given time interval.

30. The printing apparatus as set forth in claim 29, wherein the status information written to said memory includes the time period elapsed since the ink jet head was uncapped.

31. The printing apparatus as set forth in claim 29, wherein the status information includes a print pass counter indicative of the printing volume.

32. A printing apparatus in communication with a host computer for printing to a printing medium based on data received from the host computer, said printing apparatus comprising:

a memory that stores printing apparatus status information;

a controller in communication with said memory, wherein said controller controls printing apparatus operation, including writing and reading the printing apparatus status information to and from said memory, and effects an initialization process based on a reset signal generated by the host computer or by printing apparatus power on operation; and a processing unit in communication with said controller, wherein said processing unit receives a reset signal from the host computer, applies an external reset signal to said controller to inform said controller that the reset signal was received, and then applies an internal reset signal to said controller after a predetermined time delay from applying the external reset signal;

wherein said controller writes at least the printing apparatus status information required for the initialization process to said memory during the predetermined time delay in response to the external reset signal, and effects the initialization process in response to the internal reset signal.

33. The printing apparatus as set forth in claim 32, wherein the printing apparatus status information written to said memory includes information that the external reset signal was received.

34. A printing apparatus comprising:

an ink jet head cleaning mechanism;

a memory that stores printing apparatus status information;

a controller in communication with said cleaning mechanism and said memory, wherein said controller controls printing apparatus operation, including writing and reading the printing apparatus status information to and from said memory, and controls said cleaning mechanism using at least one of a plurality of process levels, each consuming a different amount of ink; and a processing unit in communication with said controller, wherein said processing unit receives a reset signal from an external source, applies an external reset signal to said controller to inform said controller that the reset signal was received, and then applies an internal reset signal to said controller after a predetermined time delay from applying the external reset signal, the internal reset signal being the same as the reset signal applied when printing apparatus power is turned on;

wherein said controller writes the printing apparatus status information to said memory during the predetermined time delay in response to the external reset signal, and, in response to the internal reset signal, reads the printing apparatus status information written to said memory, selects at least one of the plurality of process levels based on the read information, and controls said cleaning mechanism according to the at least one selected process level.

35. The printing apparatus as set forth in claim 34, wherein the status information includes time information indicative of when cleaning at a specific process level was performed, and wherein said controller calculates an elapsed time since the last cleaning at that specific process level based on the written time information and a current time, selects the at least one process level according to the elapsed time, and controls the cleaning mechanism according to the at least one selected process level.

36. The printing apparatus as set forth in claim 35, wherein the status information includes the time at which the external reset signal was applied, this time being used as the current time for calculating the elapsed time.

37. The printing apparatus as set forth in claim 34, wherein the status information includes the time at which the ink jet head is uncapped.

38. The printing apparatus as set forth in claim 34, wherein the plurality of process levels include a dummy cleaning process, which consumes no ink and is otherwise substantially the same operation as an initialization level cleaning process in which a specific amount of ink is consumed.

39. The printing apparatus as set forth in claim 38, further comprising a selector for selectively enabling or disabling the dummy cleaning process.

40. The printing apparatus as set forth in claim 34, wherein after the predetermined time delay, said processing unit outputs the internal reset signal.

41. The printing apparatus as set forth in claim 34, wherein said controller selects and implements cleaning at an initialization cleaning level in which a specific amount of ink is consumed when the status information is not stored or the stored status information is invalid.

42. The printing apparatus as set forth in claim 34, wherein said controller, after each cleaning process, writes the time of the cleaning process to said memory.

43. A printing apparatus comprising:

an ink jet head cleaning mechanism;

a memory that stores printing apparatus status information;

a controller in communication with said cleaning mechanism and said memory, wherein said controller controls printing apparatus operation, including writing and reading the printing apparatus status information to and from said memory, and controls said cleaning mechanism using at least one of a plurality of process levels, each consuming a different amount of ink; and a processing unit in communication with said controller, wherein said processing unit receives a reset signal from an external source, applies an external reset signal to said controller to inform said controller that the reset signal was received, and then applies an internal reset signal to said controller after a predetermined time delay from applying the external reset signal, the internal reset signal being the same as the reset signal applied when printing apparatus power is turned on;

wherein said controller writes the printing apparatus status information to said memory during the predetermined time delay, and, after the internal reset signal is applied, reads the printing apparatus status information written to said memory, selects at least one of the plurality of process levels based on the read information, and controls said cleaning mechanism according to the at least one selected process level; and wherein the status information is comprised of a plurality of status information units and validation information for each unit, wherein said controller selects the at least one process level based on the status information in the unit or units for which the validation information, obtained from a validation check operation performed on the corresponding status information, indicates that the corresponding status information was properly written to and stored in said memory during the predetermined time delay, and controls said cleaning mechanism according to the at least one selected process level.

44. The printing apparatus as set forth in claim 43, wherein, when an error is detected in the status information read from said memory, said controller selects and implements cleaning at an initialization level in which a specific amount of ink is consumed.

45. A medium readable by a machine, said medium storing a program of instructions capable of directing the machine to perform a control method for resetting a printing apparatus that includes a memory for storing printing apparatus status information, and a controller for controlling printing apparatus operation, including writing and reading information to and from the memory, said control method comprising the steps of:

receiving a reset signal generated by an external source or by printing apparatus power on operation;

applying to the controller an external reset signal to inform the controller that the reset signal was received;

applying an internal reset signal to the controller after a specific delay from applying the external reset signal;

writing to the memory at least the printing apparatus status information during the specific delay in response to the external reset signal;

reading the printing apparatus status information in response to the internal reset signal; and effecting an initialization process based on the read printing apparatus status information in response to the internal reset signal.

46. The machine readable medium as set forth in claim 45, wherein the printing apparatus status information written to the memory includes information that the external reset signal was received.

47. A medium readable by a machine, said medium storing a program of instructions capable of directing the machine to perform a control method for resetting a printing apparatus that includes a memory for storing printing apparatus status information, and a controller for controlling printing apparatus operation, including writing and reading information to and from the memory, said control method comprising the steps of:

initializing an ink jet head cleaning mechanism, and controlling the cleaning mechanism using one of a plurality of process levels, each consuming a different amount of ink;

receiving a reset signal, and applying to the controller an external reset signal to inform the controller that the reset signal was received;

writing the printing apparatus status information to the memory in response to the external reset signal;

applying an internal reset signal to the controller after a specific delay from applying the external reset signal, the internal reset signal being the same as the reset signal applied when printing apparatus power is turned on;

reading the printing apparatus status information written to the memory, and selecting at least a specific one of the plurality of process levels based on the read information in response to the internal reset signal; and controlling the cleaning mechanism according to the at least one selected specific process level.

48. The machine readable medium as set forth in claim 47, further comprising the step of:

performing a dummy cleaning process following the cleaning mechanism control step, the dummy cleaning process consuming no ink and otherwise being substantially the same operation as an initialization level cleaning process in which a specific amount of ink is consumed.

49. The machine readable medium as set forth in claim 47, wherein said process level selection step comprises determining whether the dummy cleaning process is performed.

50. The machine-readable medium as set forth in claim 47, wherein the status information includes time information indicative of when cleaning at a specific process level was performed, and wherein said process level selection step comprises calculating an elapsed time since the last cleaning process at that specific process level based on the time information and a current time, and selecting the at least one process level according to the elapsed time.

51. The machine readable medium as set forth in claim 50, wherein the status information includes the time at which the external reset signal was applied, this time being used as the current time for calculating the elapsed time.

52. The machine readable medium as set forth in claim 47, wherein the status information includes the time at which the ink jet head is uncapped.

53. The machine readable medium as set forth in claim 47, wherein the process level selection step comprises cleaning at an initialization level in which a specific amount of ink is consumed when the status information is not stored or the stored status information is invalid.

54. The machine readable medium as set forth in claim 47, wherein the internal reset signal applying step is performed after an amount of time required to write the printing apparatus status information to the memory has lapsed.

55. A medium readable by a machine, said medium storing a program of instructions capable of directing the machine to perform a control method for resetting a printing apparatus that includes a memory for storing printing apparatus status information, and a controller for controlling printing apparatus operation, including writing and reading information to and from the memory, said control method comprising the steps of:

initializing an ink jet head cleaning mechanism, and controlling the cleaning mechanism using one of a plurality of process levels, each consuming a different amount of ink;

receiving the reset signal, and applying to the controller an external reset signal to inform the controller that the reset signal was received;

writing the printing apparatus status information to the memory;

applying an internal reset signal to the controller after a specific delay from applying the external reset signal, the internal reset signal being the same as the reset signal applied when printing apparatus power is turned on;

reading the printing apparatus status information written to the memory, and selecting at least a specific one of the plurality of process levels based on the read information; and controlling the cleaning mechanism according to the at least one selected specific process level;

wherein the status information is comprised of a plurality of status information units and validation information for each unit; and wherein the process level selection step comprises selecting the at least one process level based on status information for the unit or units for which the validation information, obtained from a validation check operation performed on the corresponding status information, indicates that the corresponding status information was properly written to and stored in the memory.

56. The machine readable medium as set forth in claim 55, wherein the process level selection step comprises selecting cleaning at an initialization level in which a specific amount of ink is consumed when an error is detected in the printing apparatus status information read from the memory.

* * * * *

UNITED STATES PATENT AND TRADEMARK OFFICE

CERTIFICATE OF CORRECTION

PATENT NO. : 6,364,442 B1
DATED : April 2, 2002
INVENTOR(S) : Yuji Kawase et al.

It is certified that error appears in the above-identified patent and that said Letters Patent is hereby corrected as shown below:

Title page,
Item [54], Title, change "PRINTING APPARATUS, AND A CONTROL METHOD FOR RESETTING THE PRINTING APPARATUS" to -- PRINTING APPARATUS, AND A CONTROL METHOD FOR RESETTING THE PRINTING APPARATUS AND SELECTIVELY CLEANING THE PRINT HEAD --

Signed and Sealed this

Eighth Day of October, 2002

*Attest:*

*Attesting Officer*

JAMES E. ROGAN
*Director of the United States Patent and Trademark Office*